US006170775B1

(12) United States Patent
Kovacik et al.

(10) Patent No.: US 6,170,775 B1
(45) Date of Patent: Jan. 9, 2001

(54) ELECTRICAL CORD REEL

(75) Inventors: James D. Kovacik, Brecksville; Paul S. Blanch, Broadview Heights; Stanley E. Grzywna, Elyria, all of OH (US)

(73) Assignee: Alert Stamping & Mfg. Co., Inc., Bedford Heights, OH (US)

( * ) Notice: Under 35 U.S.C. 154(b), the term of this patent shall be extended for 0 days.

(21) Appl. No.: 09/325,615

(22) Filed: Jun. 3, 1999

(51) Int. Cl.[7] ..... B65H 75/38
(52) U.S. Cl. ..... 242/404; 242/405.3; 242/379.2
(58) Field of Search ..... 242/404, 404.2, 242/588, 399.2, 405.3, 405.2, 385.4, 379, 379.2; 191/12.2 R, 12.4; 248/223.41, 224.61; 403/381

(56) References Cited

U.S. PATENT DOCUMENTS 3,619,518 11/1971 Blanch et al. .
3,715,526 2/1973 Blanch et al. .
3,808,382 4/1974 Blanch et al. .
4,282,954 * 8/1981 Hill .
4,407,460 * 10/1983 Khudaverdian ..... 242/404 X
5,158,450 * 10/1992 Horita et al. ..... 242/379.2 X
5,209,420 * 5/1993 Simmons et al. ..... 242/399.2 X
5,934,598 * 8/1999 Kovacik et al. ..... 242/405.3 X

* cited by examiner

*Primary Examiner*—William Rivera
*Assistant Examiner*—William A. Rivera
(74) *Attorney, Agent, or Firm*—MacMillan, Sobanski & Todd, LLC

(57) ABSTRACT

A retracting extension cord reel includes a mounting bracket, a housing bracket removably and pivotally attached to the mounting bracket, and a cord reel housing attached to the housing bracket. When the mounting bracket is attached to a mounting surface, the housing can be moved toward and away from the mounting surface. When the housing bracket is detached from the mounting bracket, the housing bracket can be used as a handle for carrying the housing to a remote location. The cord reel is particularly useful for powering small appliances and electrical tools, and can incorporate a resettable circuit breaker.

6 Claims, 4 Drawing Sheets

ELECTRICAL CORD REEL

BACKGROUND OF THE INVENTION

The present invention relates generally to an electrical extension cord reel. More specifically, the present invention relates to an automatically retracting cord reel configured specifically for use with small appliances, electrical tools and the like which reel can be mounted for use in a specific location and easily removed from its mounting place and used remotely.

Take-up reels for managing the use and storage of electrical extension cords are known. Such reels consist basically of a spool rotatably affixed to a structural component whereby the spool is manually or automatically rotated to wind an extension cord thereabout. Typically, such automatic reels employ a variety of spring and ratchet mechanisms for maintaining the cord in the extended position and rewinding the cord onto the spool when it is no longer needed. Such reels are particularly useful in industrial or commercial settings such as automobile repair shops, machine shops, carpentry shops and construction sites. They permit workers to readily access electrical power as needed for the operation of portable electric tools, test devices, and trouble lights at various locations remote from an existing power outlet. In addition, the use of extension cord reels makes it possible to use only pigtails, short electrical cords, on the various electrical tools and devices thereby simplifying the movement and storage of the electrical tools and devices themselves.

While exterior designs may vary, retracting electric cord reels basically comprise a spool mounted on a shaft supported for rotation on a bracket or housing, a cooperating ratchet and pawl to arrest the rotation of the spool when the cord has been paid out to a desired length, a spring for rotating the spool in a direction to rewind the cord when the ratchet and pawl are disengaged and an electrical power input means including a commutator connected between a male plug extending from the housing and the extension cord wound on the spool. Such devices are shown, for example, in the U.S. Pat. Nos. 3,619,518; 3,715,526; and 3,808,382.

SUMMARY OF THE INVENTION

The present invention concerns a retracting extension cord reel assembly configured specifically for use with small electrical appliances and tools.

The reel assembly according to the present invention includes a mounting bracket for attaching the reel to a mounting surface for use in a fixed location. A housing bracket is removably and pivotally attached to the mounting bracket and a cord reel housing is integral to the housing bracket. The housing can be pivoted between positions adjacent the mounting surface for storage when not in use and an extended position for use. The mounting surface typically can be the underside of a wall cabinet, a wall between upper and lower kitchen cabinets, or even inside a cabinet.

The housing bracket is detachable from the mounting bracket and forms a handle for carrying the reel housing to another location. A resettable circuit breaker is incorporated into the housing and connected between the extension cord with a female socket and a pigtail with a male plug.

One object of the invention is to provide a retractable cord reel configured to provide maximum usefulness in the kitchen environment.

Another object of the invention is to provide a retractable cord reel that is configured to be stored out of sight and that can easily be moved to a remote location as needed.

Still another object of the invention is to provide a retractable cord reel that can be relocated to other fixed positions or detached and used separately from its mounting bracket.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
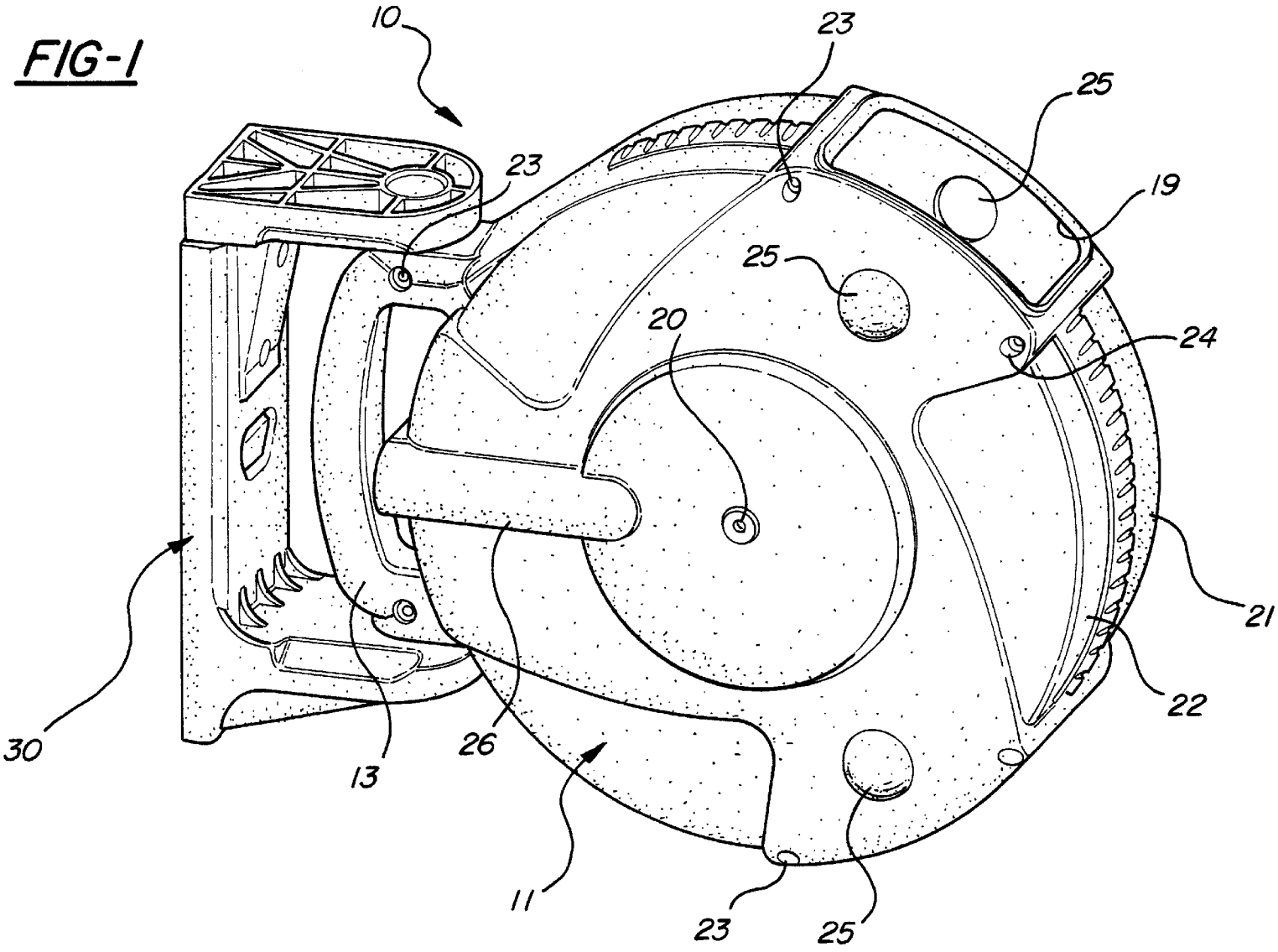
FIG. 1 is a perspective view of a retractable cord reel apparatus in accordance with the present invention.
Figure 2:
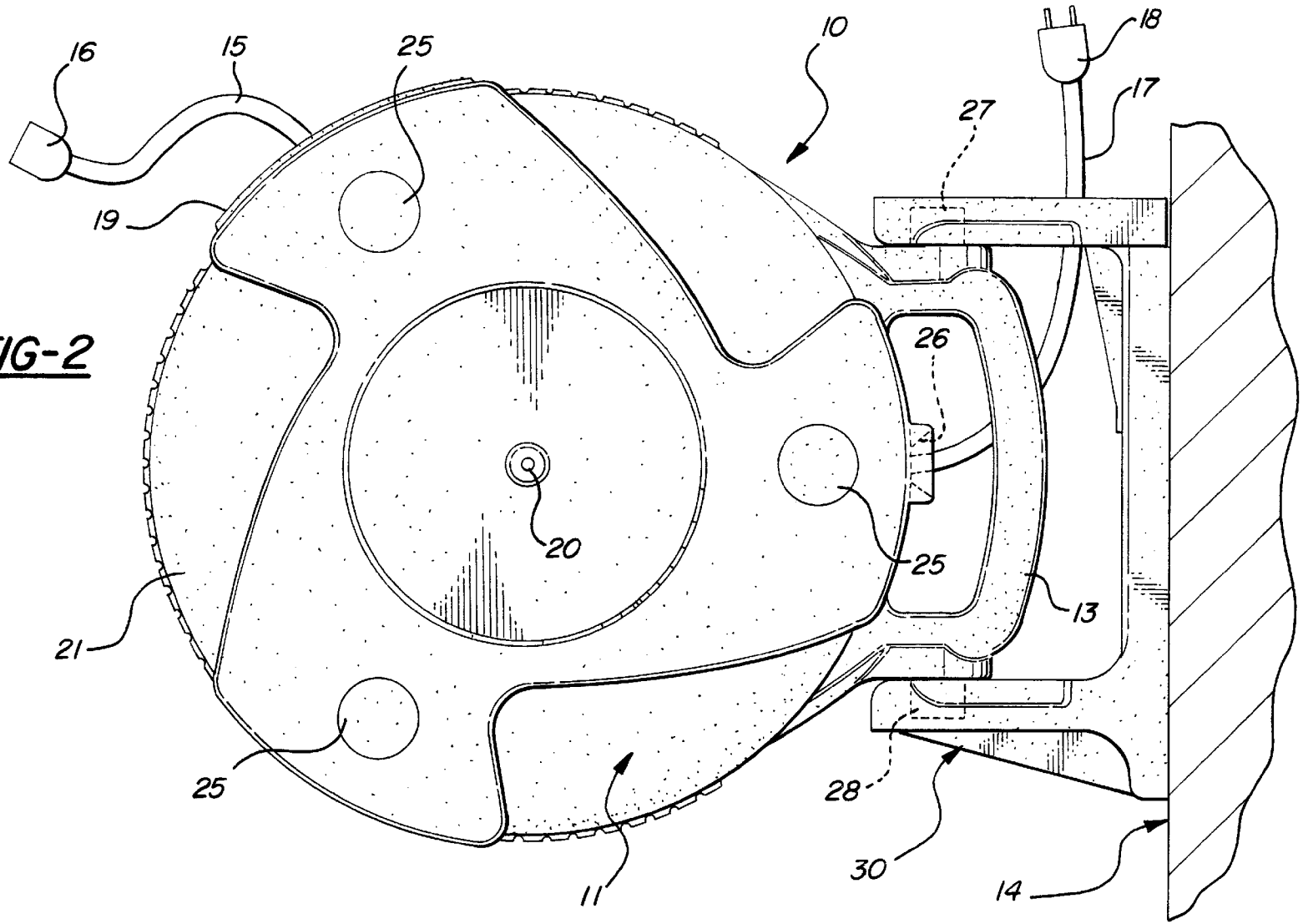
FIG. 2 is a right side elevational view of the cord reel apparatus shown in the FIG. 1 removably attached to a mounting surface by a mounting bracket.

There is shown in the FIGS. 1–2 an automatically retracting electrical extension cord reel assembly 10 including a cord reel housing 11, a mounting bracket 30 and a housing bracket 13 integral to the housing and removably attached to the mounting bracket. In the FIG. 2, the assembly 10 is shown mounted on a surface 14 extending in a generally vertical plane. Although the FIG. 2 is designated a "right side" elevational view, the assembly 10 can be mounted on any suitable surface in any orientation. Therefore, these designations and any following orientation references are relative and in no way intended to limit the positioning of the apparatus 10 according to the present invention.

The cord reel apparatus 10 includes conventional electrical cords for connection between a source of power, such as a wall outlet, and an electrical device to be powered. These cords are shown only in the FIG. 2 and include a retractable extension cord 15 having a female electrical socket 16 connected to a free end thereof and a fixed pigtail 17 having a male electrical plug 18 connected to a free end thereof. The extension cord 15 extends through an opening 19 (see the FIG. 1) formed in the housing 11 and is wound upon a spool (not shown) rotatably supported in the housing on an axle 20. The pigtail 17 is of a length sufficient to reach from the housing 11 to a nearby electrical outlet. For example, the pigtail 17 can be about fifteen inches long and the plug 18 can be a conventional two prong, polarized type. The electrical connection between the extension cord 15 and the pigtail 17 is made by conventional commutator (not shown) in the housing 11. Typical spools, axles, rewind springs, ratchet and pawl mechanisms and electrical connections are shown in the U.S. Pat. No. 3,715,526 and the U.S. Pat. No. 4,726,538, both incorporated herein by reference.

The housing 11 is formed of a pair of generally cup-shaped shells, a right hand shell 21 and a substantially mirror image left hand shell 22. The shells 21 and 22 are formed of a suitable material such as molded ABS flame-retardant plastic and are retained together by a plurality of integral locks. The left hand shell 22 has a plurality of threaded fasteners 23 received in apertures 24 spaced about a periphery thereof. Each of the fasteners 23 releasably engages a corresponding one of a plurality of internal blind holes (not shown) spaced about the periphery of the right hand shell 21. The fasteners 23 function as releasable locks holding the shells 21 and 22 together.

Also present on the exterior of the shells 21 and 22 are a plurality of generally hemispherical supports 25 formed by bumping out portions of the side walls of the shells 21 and 22 at uniformly spaced points adjacent the peripheries thereof. For example, three of the supports 25 are equally spaced on the right hand shell 21 and two of the supports 25 are formed on the left hand shell 22 opposite two of the supports on the right hand shell. A portion 26 of the side wall of the left hand shell 22 extends outwardly and radially to form a passage for the pigtail 17 inside the housing 11 and is open at the periphery of the housing to provide an exit for the pigtail. The portion 26 is opposite the third support on the right hand shell 21 and also functions as a support. Such supports serve to elevate the cord reel housing 11 above the ground when the housing is used detached from the mounting bracket and placed on one side or the other.

The cord reel housing 11 has an integrated handle portion 13. The integrated handle portion 13 includes a pair of opposing generally cylindrical posts 27 and 28 (as shown in FIG. 2) that permit the cord reel housing 11 to be pivotally attached to the mounting bracket 30 in a removable manner. The integrated handle portion 13 permits the cord reel case to be easily transported to locations remote from the mounting bracket 30.

Figure 3:
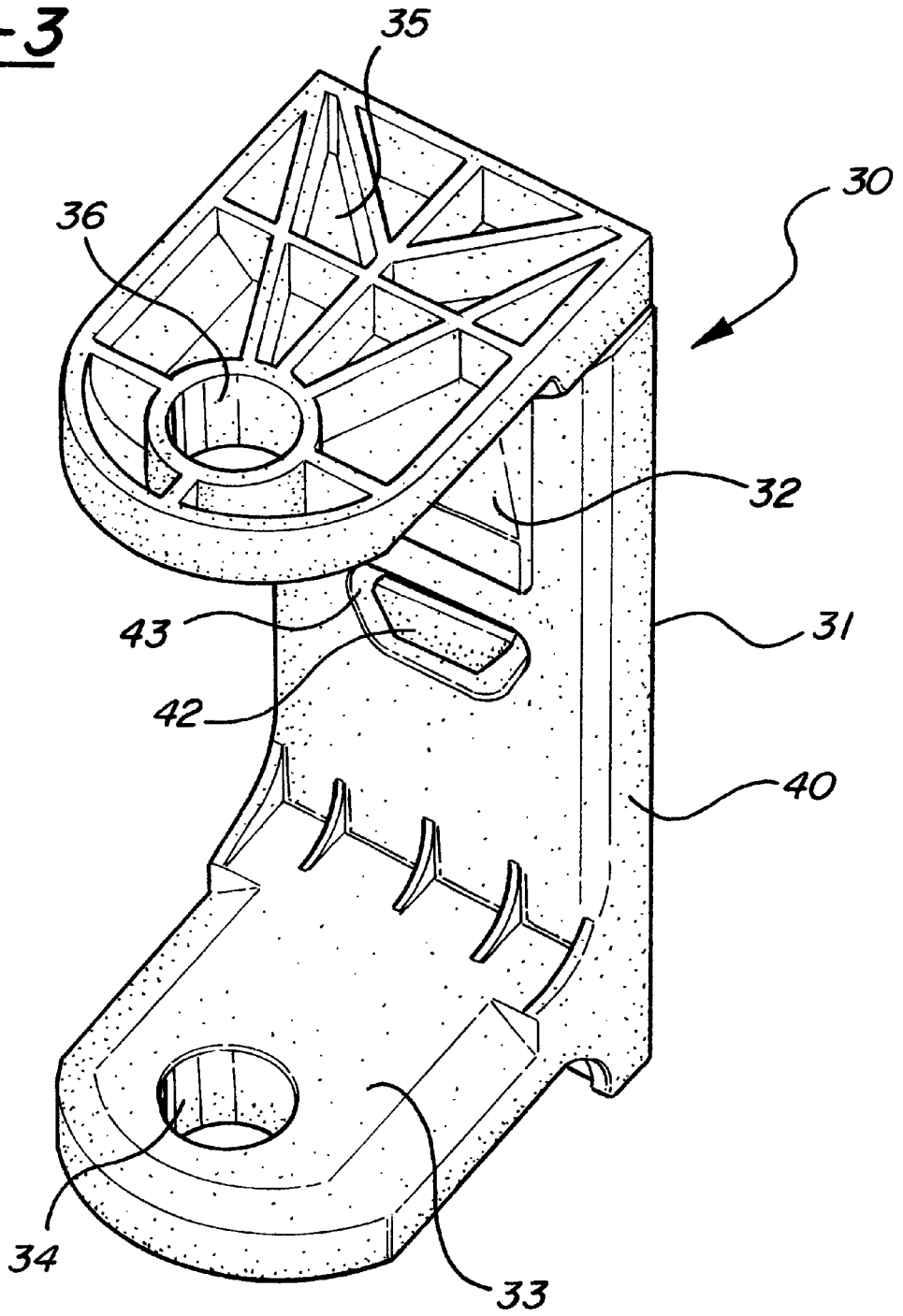
FIG. 3 is a perspective view of the mounting bracket shown in the FIG. 2.
Figure 5:
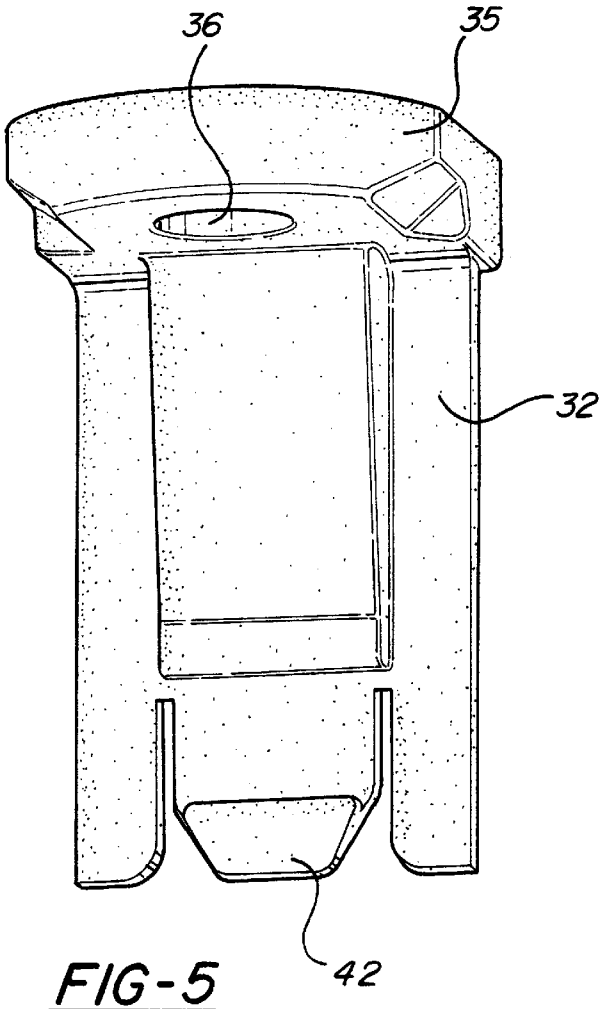
FIG. 5 is a perspective view of the second base segment of the mounting bracket shown in the FIGS. 1–4.
Figure 4:
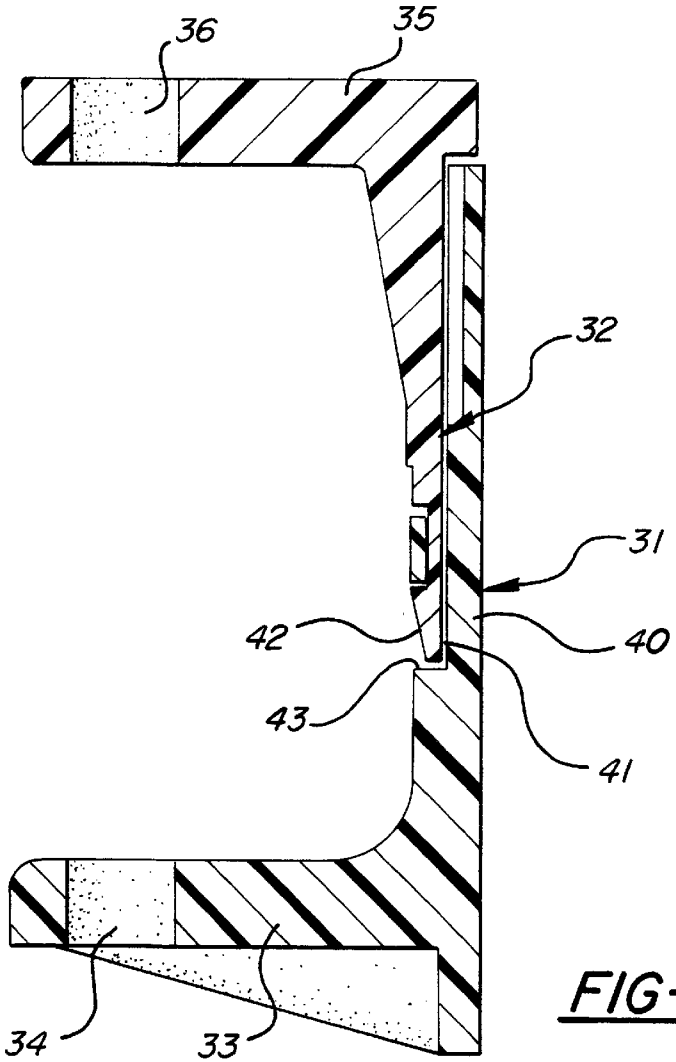
FIG. 4 is a cross-sectional view of the mounting bracket shown in the FIGS. 1–3.

The mounting bracket 30 is shown in more detail in the FIGS. 3–5. The bracket 30 has a generally elongated, planar base with a transversely extending arm at either end thereof. The base is formed from a first base segment 31 and a second base segment 32. The first base segment 31 is connected to a first mounting arm 33 extending generally perpendicular from one end the first base segment 31. The first mounting arm 33, contains a first socket 34. The second base segment 32 is connected to a second mounting arm 35 extending generally perpendicular from one end of the second base segment 32 and generally parallel to the first mounting arm 33. The second mounting arm 35 contains a second socket 36. The first socket 34 and the second socket 36 are each configured to correspond in size and shape with one of the opposing posts 27 and 28.

As shown in FIGS. 3 and 4, the first base segment 31 is a generally planar body 40 having a cavity 41 formed therein that is open at the end of the first base segment opposite the arm 33. The second base segment 32 comprises a generally planar body configured to slide into the cavity 41. The second base segment 32 has a catch 42 formed thereon for engaging a stop aperture 43 extending from the cavity 41 to the exterior of the body 40. The catch 42 locks the second base segment 32 and the first base segment 31 in a position such that the posts 28 and 27 are rotatably engaged in the first socket 34 and the second socket 36 respectively. In order to remove the cord reel housing 11 from the mounting bracket 30, the catch 42 is deflected inwardly to disengage from the aperture 43 and permit the second base segment 32 to be slideably disengaged from the first base segment 31.

The mounting bracket 30 can be secured to any convenient surface 14 using screws or other fastening means through apertures (not shown) in the first base segment 31. Alternatively, the mounting bracket can be mounted on the surface using a self-stick adhesive material such as a conventional double-sided tape. The mounting bracket 30 can be formed from any suitable metal or plastic material such as high impact ABS or a polycarbonate plastic.

The cord reel apparatus 10 according to the present invention can include a resettable circuit breaker that is connected between the extension cord 15 and the pigtail 17. Such a circuit breaker may be mounted inside the housing 11 with a reset button exposed at any convenient location.

The mounting bracket 30 permits the cord reel housing 11 to be mounted in a variety of convenient locations. For example, the cord reel housing could be mounted in a kitchen, workshop, or garage on a vertical wall surface, between upper and lower cabinets and shelves, on the underside of upper cabinets, or inside cabinets. In any of these locations, the housing 11 may be oriented in one position for storage pivoted on the posts 27 and 28 to rest flat against the mounting surface, and in another for use position pivoted away from the mounting surface.

The assembly 10 also can be mounted inside a lower kitchen cabinet to completely hide it from view. Current garbage disposal units typically are designed to plug into standard duplex electrical outlet boxes located inside most lower kitchen cabinets below the sink where the disposal is installed. It is very convenient to plug the pigtail 17 into the same outlet box and mount the assembly 10 inside the cabinet on the cabinet wall or on the exposed kitchen wall.

Because the cord reel housing 11 can be easily removed from the mounting bracket 30, the housing 11 becomes a portable cord reel. When, for example, a worker needs an extension cord at a remote location, the cord reel housing according to the present invention can be unplugged if necessary, removed from the mounting bracket 30, carried to the desired location, plugged in and used, and then returned to the mounting bracket 30.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A retracting extension cord reel apparatus comprising:

a cord reel housing for storing an electrical cord;

a handle portion attached to said cord reel housing and having a pair of opposing posts extending therefrom; and a mounting bracket having a first base segment adapted to be attached to a generally planar mounting surface and a second base segment releasably attached to said first base segment, each of said first and second base segments having a socket for pivotally retaining an associated one of said posts, whereby when said mounting bracket is attached to a generally planar surface, said cord reel housing can be pivoted adjacent the planar surface for storage and when said second base segment is released from said first base segment, said mounting bracket can be removed from said mounting bracket and hand carried by said handle portion.

2. The apparatus according to claim 1 wherein said first base segment includes a generally planar body having a cavity formed thereon open at one end and said second base segment includes a generally planar body configured to fit into said cavity at said open one end so that said second base segment is slidably received by said first base segment.

3. The apparatus according to claim 1 including a catch formed on said second base segment, said catch engaging at stop aperture formed in said first base segment to lock said second base segment and said first base segment in a position in which said posts are engaged with said sockets, wherein said catch is capable of being deflected to disengage from said stop aperture and permit said second base segment to be disengaged from said first base segment.

4. The apparatus according to claim 1 wherein said cord reel housing has a plurality of outwardly extending spaced apart supports formed on an exterior surface thereof for supporting said cord reel housing above a surface when said cord reel housing is disengaged from said mounting bracket.

5. An extension cord reel apparatus for storing an electrical cord to be extended from and rewound into a housing comprising:

a cord reel housing for storing said electrical cord, a handle portion formed integral with said cord reel housing and having a pair of opposing posts extending therefrom; and a mounting bracket adapted to be attached to a generally planar mounting surface, said mounting bracket having a first mounting arm containing a first socket, said first mounting arm connected to a first base segment, and a second mounting arm containing a second socket, said second mounting arm connected to a second base segment, said second base segment slidably engaging said first base segment; and a lock means for releasably attaching said first base segment to said second base segment thereby pivotally retaining said posts in respective ones of said first and second sockets, said lock means being actuatable to release said second base segment from said first base segment whereby said cord reel housing can be removed from said mounting bracket and hand carried by said handle portion.

6. The apparatus according to claim 5 wherein said lock means includes a deformable catch formed on said second base segment and a cooperating stop aperture formed in said first base segment, said catch being capable of being deflected to disengage from said stop aperture.

* * * * *